United States Patent [19]

Ishibashi et al.

[11] Patent Number: 4,570,445

[45] Date of Patent: Feb. 18, 1986

[54] METHOD OF ABSORBING THERMAL ENERGY AT LOW TEMPERATURE

[75] Inventors: Kiyoshi Ishibashi, Toyota; Yujiro Ukai, Nagoya; Hideo Mita, Okazaki; Yoshihira Shiroshita, Toyota, all of Japan

[73] Assignee: Aisin Seiki Kabushiki Kaisha, Kariya, Japan

[21] Appl. No.: 624,206

[22] Filed: Jun. 25, 1984

[30] Foreign Application Priority Data

Jun. 24, 1983 [JP] Japan ..... 58-114856

[51] Int. Cl.[4] ..... F25B 9/00

[52] U.S. Cl. ..... 62/6; 60/520; 62/86

[58] Field of Search ..... 62/6, 86; 60/520

[56] References Cited

U.S. PATENT DOCUMENTS 3,214,924 11/1965 van Geuns et al. ..... 62/6
3,630,041 12/1971 Daniels et al. ..... 62/6
3,862,546 1/1975 Daniels ..... 62/6

*Primary Examiner*—Ronald C. Capossela
*Attorney, Agent, or Firm*—Oblon, Fisher, Spivak, McClelland & Maier

[57] ABSTRACT

The maximum pressure of a working medium is reduced to or below the critical pressure of the working medium, or the critical pressure of the working medium is selected to lie between the maximum and minimum pressures of the working medium in a refrigerating machine having a compressor, a radiator, a heat exchanger, and an expander which are in successive communication, and the working medium is liquified partly or wholly in the heat exchanger and/or the expander.

4 Claims, 6 Drawing Figures

METHOD OF ABSORBING THERMAL ENERGY AT LOW TEMPERATURE

BACKGROUND OF THE INVENTION

1. Field of the Invention

The present invention relates to a method of absorbing thermal energy at a low temperature, and more particularly to a method of efficiently absorbing thermal energy at a temperature below the critical temperature of a working medium in a refrigerating machine such as, for example, a Stirling-cycle refrigerating machine having a compressor, a radiator, a heat exchanger and an expander.

2. Discussion of the Background

One known method of absorbing thermal energy at a low temperature is disclosed in Japanese Patent Application published on May 4, 1976 as Publication No. 51-13900. The prior art method continuously maintains the pressure of a working medium higher than a pressure substantially equal to the critical pressure in a refrigerating machine having a compressor, a radiator, a heat exchanger, and an expander, and lowers the temperature of the expander below the critical temperature of the working medium for thereby absorbing the thermal energy. With the prior art method, however, the thermal energy cannot efficiently be absorbed since no condition is varied if the working medium is expanded for heat absorption at a temperature lower than the critical temperature. Such a condition will be described with reference to the T-S diagram shown in FIG. 1 of the accompanying drawings, in which helium is employed as the working medium. An amount QE of absorbed heat which is generated by expansion of the working medium in the expander and various amounts of mechanical work W transferred from an external source to the working medium for absorbing the heat are indicated by areas enclosed by a2, a2', a3', a3 and a1, a2, a3, a4, respectively. The externally applied amount of work W is close to the critical pressure in the T-S diagram, and is highly reduced in a low-temperature region below approximately the critical temperature, thus reducing the absorbed amount of heat QE.

Accordingly, the diagram indicates that COP (coefficient of performance)=QE/W representative of the efficiency of thermal energy absorption is greatly reduced. Where the working medium is a helium gas, the lowest pressure is 3 atm, the pressure ratio is 3, the temperature of the compressor is 10° K., and the temperature of the expander is 4.2° K., the COP is about 12%.

SUMMARY OF THE INVENTION

It is an object of the present invention to provide a method of efficiently absorbing thermal energy.

To achieve the above object, the maximum pressure of a working medium is reduced to or below the critical pressure of the working medium, or the critical pressure of the working medium is selected to lie between the maximum and minimum pressures of the working medium in a refrigerating machine having a compressor, a radiator, a heat exchanger, and an expander which are in successive communication, and the working medium is liquified partly or wholly in the heat exchanger and/or the expander.

According to the present invention, the following advantages can be achieved. It is assumed here that heat absorption in the case where the critical pressure of the working medium lies between the maximum and minimum pressures of the working medium is indicated by b1, b2, b3, b4 in FIG. 1. The working medium as it flows under a relatively high pressure from the compressor through the radiator and the heat exchanger to the expander is cooled and liquified in an interval from b1 to b2. When the working medium is expanded in the expander, the pressure is reduced, and a portion of the liquid starts being vaporized at a point b5. From the point b5, the working medium continues to be expanded and vaporized under constant pressure, and will be entirely vaporized at b3. During the vaporization process from b5 to b3, the working medium absorbs necessary heat of vaporization. As a result, a high degree of heat absorption can be expected.

The amount of heat Q12 (indicated by an area enclosed by b1, b2, b2', b1') discharged into the heat exchanger when the working medium moves through the heat exchanger to the expander is greater than the amount of heat Q23 (indicated by an area enclosed by b4, b3, b3', b4') absorbed from the heat exchanger when the working medium moves from the expander through the heat exchanger to the compressor. The difference between these amounts of heat flows into the expander in each cycle, so that a portion of increased heat absorption accompanying the above heat of vaporization will be consumed.

The substantial amount of heat absorption QE' taking into account a nonequilibium state between absorbed and discharged heat energies of the working medium is indicated by QE'=area b2, b2', b3', b3−(area b1, b2, b2', b1−area b4, b3, b3', b4'). With the amount of externally applied work W=area b1, b2, b3, b4, the substantial coefficient of performance COP' is indicated by COP'=QE'/E.

Where the working medium is a helium gas, and the minimum pressure is 1 atm when the pressure ratio is 3, the compressor temperature is 10° K., and the expander temperature is 4.2° K., the COP' is about 24% which is twice the coefficient of performance available with the prior art method.

An example in which the maximum pressure of the working medium is equal to or below the critical pressure thereof is illustrated in FIGS. 2 and 3 of the accompanying drawings. The COP' as determined under the same conditions as above with the minimum pressure of the working medium being 0.5 atm is about 40% which is about 3.3 times the coefficient of performance with the prior art method.

According to the present invention, furthermore, the maximum pressure of the working medium is equal to or below the critical pressure thereof, or the pressure of the working medium is selected to lie between the maximum and minimum pressures of the working medium, so that piston rings which seal the working medium in the compressor and the expander are subjected to reduced surface pressures and to reduced wear, resulting in a lower service life of the refrigerating machine. Since the space for compressing the working medium is small, the mechanical strength of the parts of the refrigerating machine may be reduced and the refrigerating machine may be small in size and light in weight.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
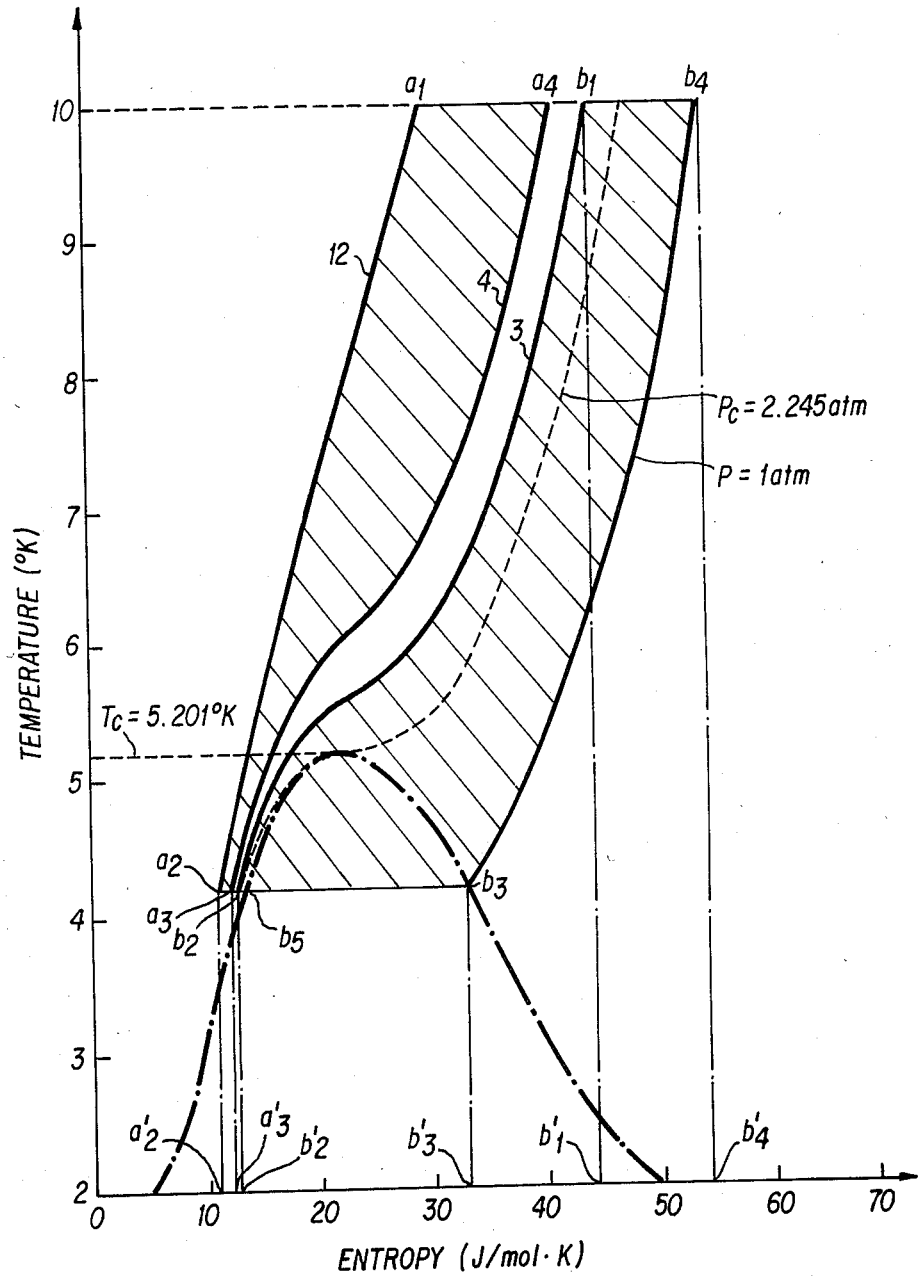
FIG. 1 PRIOR ART
FIG. 1 is a T-S diagram of a conventional method.
Figure 2:
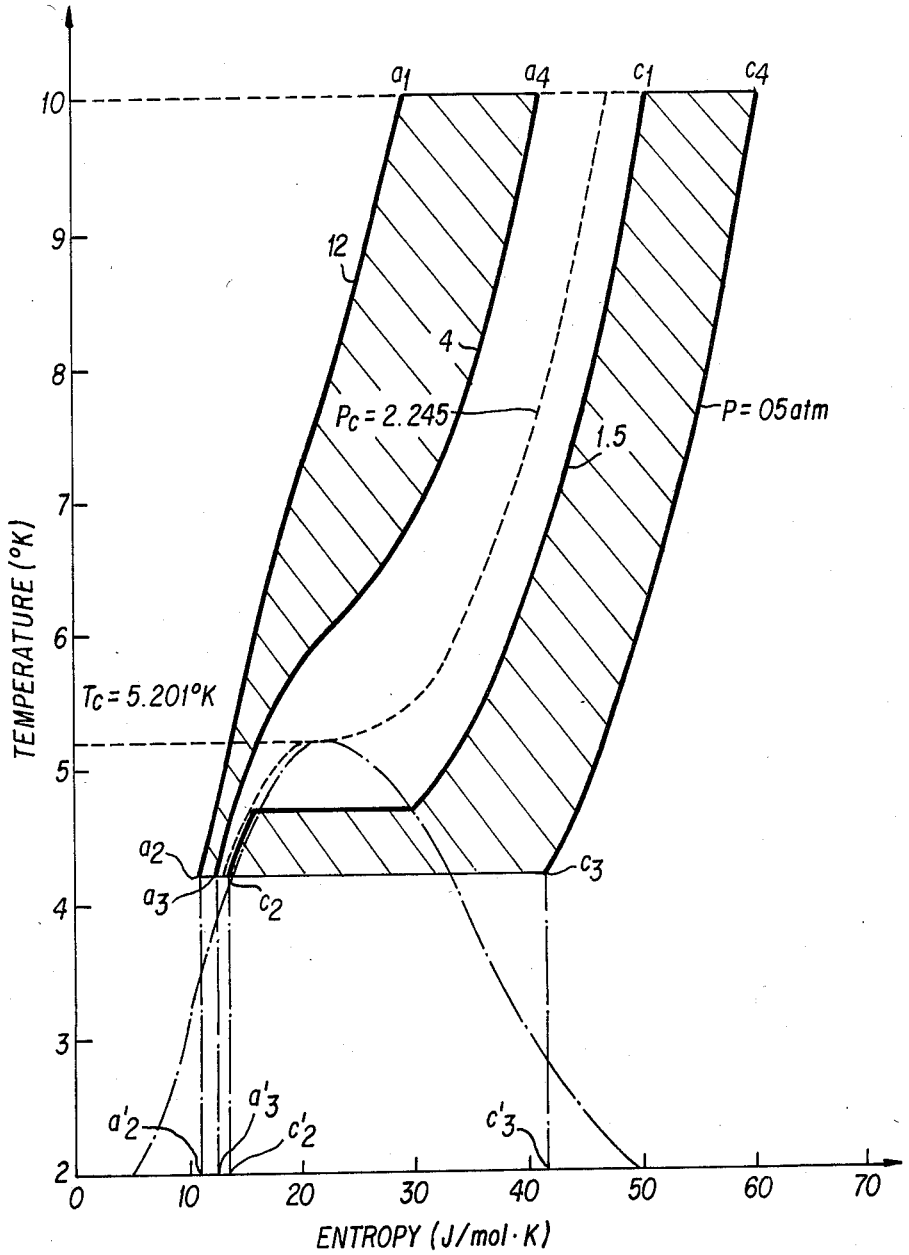
FIG. 2 is a T-S diagram of a method of the present invention in which the maximum pressure of a working medium is equal to or below the critical pressure thereof.
Figure 3:
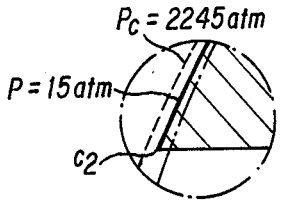
FIG. 3 is a T-S diagram indicating in an enlarged scale a portion around a point C2 in FIG. 2.
Figure 4:
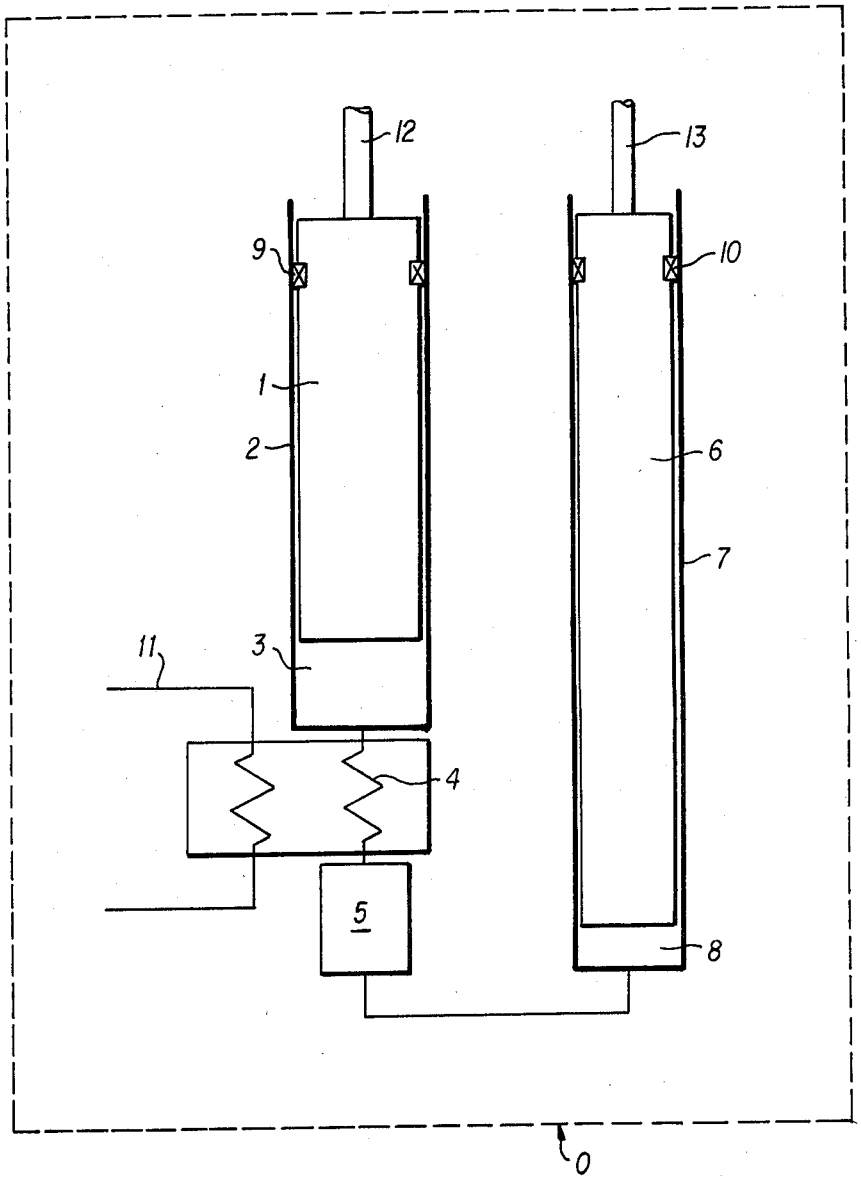
FIG. 4 is a circuit diagram of an arrangement according to a first embodiment of the present invention, in which a regenerator is used as a heat exchanger.

A first embodiment of the present invention in which a regenerator is used as a heat exchanger will be described with reference to FIG. 4. A refrigerating machine 0 includes a compressor 3 surrounded by a compressor cylinder 2, a compressor piston 1, and a piston ring 9 and communicating successively with a radiator 4, a heat exchanger (regenerator) 5, and an expander 8 surrounded by an expander cylinder 7, an expander piston 6, and a piston ring 10. These working spaces are filled with a working medium such as helium such that the maximum pressure of the working medium is equal to or below the critical pressure thereof or the critical pressure of the working medium is selected to lie between the maximum and minimum pressures of the working medium. The radiator 4 affects heat exchange between a refrigerant flowing through a passage 11 and the working medium. To the expander piston 6 and the compressor piston 1, there are fixed connecting rods 13, 12, respectively, connected to driving mechanisms (not shown) so that the movement of the expander piston 6 is about 90 degrees ahead of the movement of the compressor piston 1.

The expander piston 6 is positioned at the top dead center, and the compressor piston 1 is simultaneously started to move from the bottom dead center to the top dead center thereof. At this time, the working medium filling the compressor 3 is compressed. The top dead center is shown in FIG. 4 as being positioned below the bottom dead center.

While the compressor piston 1 is further moved toward the top dead center, the expander piston 6 is moved toward the bottom dead center to displace the working medium from the compressor 3 into the expander 8. During the flow of the working medium, the thermal energy thereof is discharged into the refrigerant flowing through the passage 11, and is also discharged into the regenerator 5, until the working medium is cooled to a temperature below the critical temperature and partly or entirely liquified in the regenerator 5 and/or the expander 8.

After the compressor piston 1 has reached the top dead center to displace the entire working medium from the compressor 3 into the expander 8, the piston 6 is moved toward the bottom dead center, whereupon the liquified working medium starts being vaporized, absorbing head from a heat source outside of the expander as heat of vaporization.

If the working medium is entirely vaporized before the expander piston 6 reaches the bottom dead center, the working medium performs expanding work and continuously absorbs heat from the time when the working medium is entirely vaporized to the time the expander piston 6 reaches the bottom dead center.

The working medium as it has expanded and absorbed heat in the expander 8 is displaced from the expander 8 through the regenerator 5 and the radiator 4 into the compressor 3 when the expander piston 6 is moved toward the top dead center and at the same time the compressor piston 1 is moved from the top dead center to the bottom dead center. At this time, the working medium absorbs thermal energy in the regenerator 5. When the working medium returns to the compressor 3, it has been heated to the same temperature as that which the working medium has had at the beginning of the cycle.

When the expander piston 6 reaches the top dead center and the compressor piston 1 simultaneously reaches the bottom dead center, the cycle is completed, and the same cycle of operation will be repeated subsequently.

Figure 5:
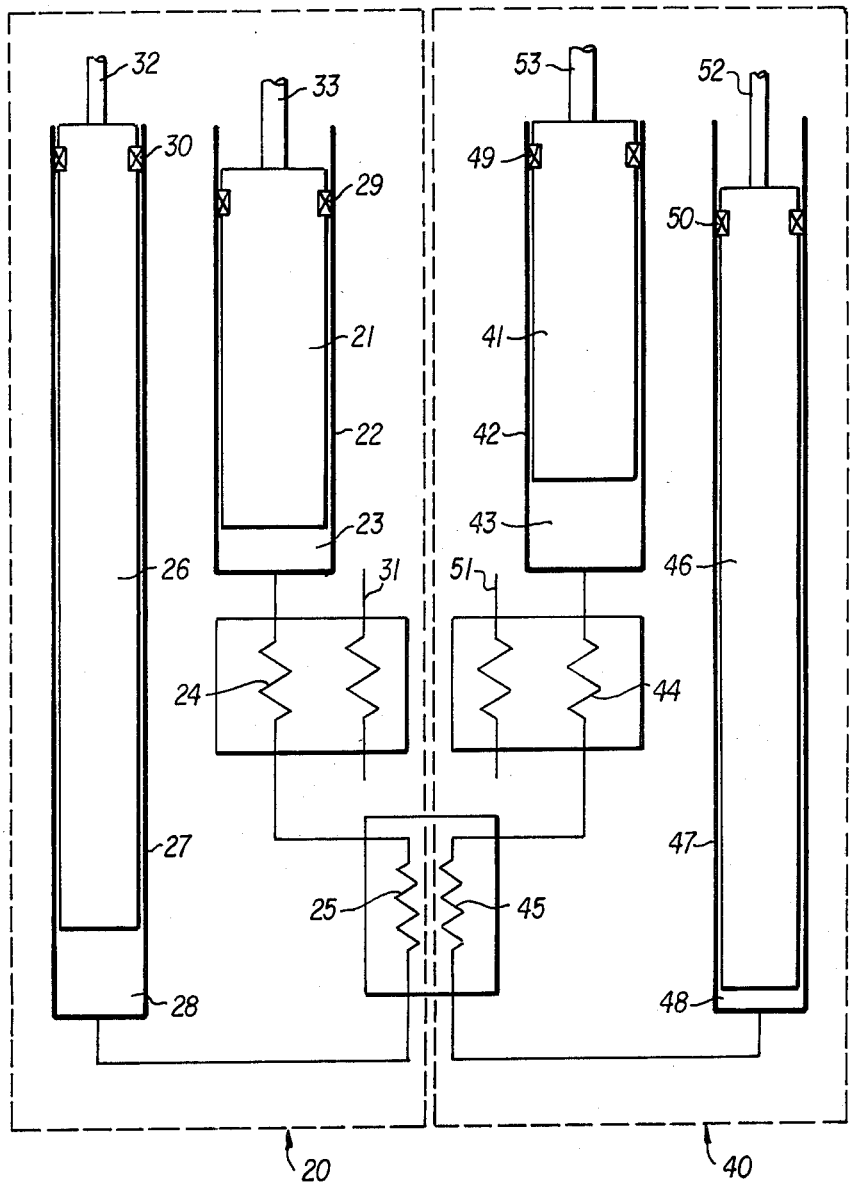
FIG. 5 is a circuit diagram of an arrangement according to a second embodiment of the present invention, in which a heat exchanger unit is used as a heat exchanger.

FIG. 5 is illustrative of a system according to a second embodiment which has a plurality of refrigerating machines with a common heat exchanger composed of a heat exchanger unit for the exchange of thermal energy for working mediums in the respective refrigerating machines.

Each refrigerating machine 20 (40) includes a compressor 23 (43) surrounded by a compressor cylinder 22 (42), a compressor piston 21 (41), and a piston ring 29 (49) and communicating successively with a radiator 24 (44), a heat exchanger (heat exchanger unit) 25 (45), and an expander 28 (48) surrounded by an expander cylinder 27 (47), an expander piston 26 (46), and a piston ring 30 (50). These working spaces are filled with a working medium such as helium such that the maximum pressure of the working medium is equal to or below the critical pressure thereof or the critical pressure of the working medium is selected to lie between the maximum and minimum pressures of the working medium. The radiator 24 (44) has a passage 31 (51) for effecting heat exchange between a refrigerant flowing through the passage 31 (51) and the working medium. Connected to the expander piston 26 (46) and the compressor piston 21 (41) are connecting rods 32 (52), 33 (53), respectively, connected to driving mechanisms (not shown) so that the movement of the expander piston 26 (46) is about 90 degrees ahead of the movement of the compressor piston 21 (41).

Thermal energy can be exchanged between the working medium flowing through the heat exchanger (heat exchanger unit 25) in the refrigerating machine 20 and the working medium flowing through the heat exchanger (heat exchanger unit 45) in the refrigerating machine 40. The refrigerating machines 20, 40 will operate about 180 degrees out of phase with each other, that is, the expander piston 26 and the compressor piston 21 in the refrigerating machine 20 and the expander piston 46 and the compressor piston 41 in the refrigerating machine 40 will move about 180 degrees out of phase with each other.

The system of FIG. 5 will operate as follows. Each of the refrigerating machines 20, 40 operates on the same principle as the refrigerating machine shown in FIG. 4 does. More specifically, the working medium compressed in the compressor 23 (43) and having discharged heat of compression in the radiator 24 (44) discharges thermal energy into the other working medium in the heat exchanger units 25, 45. The working medium is now cooled to a temperature equal to or below the critical temperature, so that the working medium will partly or entirely be liquified in the heat exchanger unit 25 (45) and/or the expander 28 (48).

To allow the thermal energy to flow efficiently in the heat exchanger unit 25 (45), the refrigerating machines 20, 40 operate about 180 degrees out of phase. When the working medium radiates heat in the heat exchanger unit 25 in one of the refrigerating machines 20 (that is, when the working medium flows from the compressor 23 to the expander 28), the working medium flows from the expander 48 to the compressor 43 in the other refrigerating machine 40, absorbing the amount of heat discharged from the refrigerating machine 20 through the heat exchanger unit 45.

In each of the expanders, the working medium is expanded and vaporized to absorb a large amount of heat of vaporization when the expander piston 26 (46) is moved toward the bottom dead center.

Although the system of FIG. 5 has a combination of two refrigerating machines 20, 40, the embodiment of FIG. 5 covers a combination of three or more refrigerating machines in which the working medium in one refrigerating machines exchanges heat, in its heat exchanger unit, with the working mediums flowing through the heat exchanger units in the other refrigerating machines.

Figure 6:
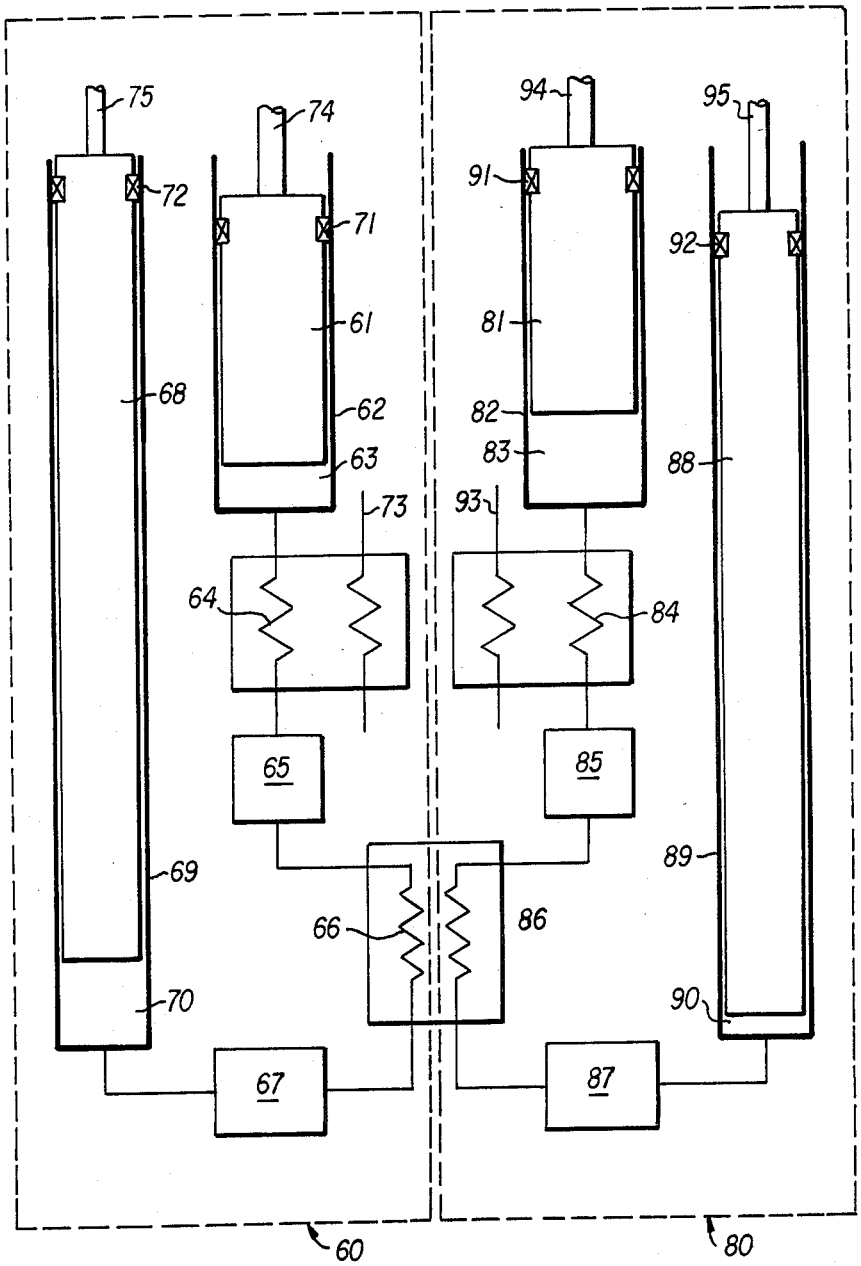
FIG. 6 is a circuit diagram of an arrangement according to a third embodiment of the present invention, in which one or more regenerators and one or more heat exchanger units are connected in series as a heat exchanger.

FIG. 6 shows a system according to a third embodiment in which a heat exchanger is composed of one or more regenerators and one or more heat exchanger units.

Each refrigerating machine 60 (80) includes a compressor 62 (82) surrounded by a compressor cylinder 62 (82), a compressor piston 61 (81), and a piston ring 71 (91) and communicating successively with a radiator 64 (84), a regenerator 65 (85), a heat exchanger unit 66 (86), another regenerator 67 (87), and an expander 70 (90) surrounded by an expander cylinder 69 (89), an expander piston 68 (88), and a piston ring 72 (92). These working spaces are filled with a working medium such as helium such that the maximum pressure of the working medium is equal to or below the critical pressure thereof or the critical pressure of the working medium is selected to lie between the maximum and minimum pressures of the working medium. The radiator 64 (84) has a passage 73 (93) for effecting heat exchange between a refrigerant flowing through the passage 73 (93) and the working medium. The working medium flowing through the heat exchanger unit 66 in the refrigerating machine 60 can exchange heat with the working medium flowing through the heat exchanger unit 86 in the refrigerating machine 80. To the expander piston 68 (88) and the compressor piston 61 (61), there are fixed connecting rods 75 (95), 74 (94), respectively, connected to drivers (not shown) so that the movement of the expander piston 68 (88) is about 90 degrees ahead of the movement of the compressor piston 61 (81). The refrigerating machines 60, 80 will operate substantially 180 degrees out of phase with each other.

Operation of the system of FIG. 6 is substantially the same as that of the system of the previous embodiment shown in FIG. 5. More specifically, the working medium compressed in the compressor 63 (83) and having discharged heat of compression in the radiator 64 (84) discharges thermal energy into the regenerator or the other working medium in the regenerator 65 (85), the heat exchanger unit 66 (86), and the regenerator 67 (87). The working medium is now cooled to a temperature equal to or below the critical temperature, so that the working medium will partly or entirely be liquified in the regenerator 67 (87) and/or the expander 70 (90).

In each of the expanders, the working medium is expanded and vaporized to absorb a large amount of heat of vaporization when the expander piston 68 (88) is moved to the bottom dead center.

Although the system of FIG. 6 has a combination of two refrigerating machines 60, 80, the embodiment of FIG. 6 covers a combination of three or more refrigerating machines in which the working medium in one refrigerating machines exchanges heat, in its heat exchanger unit, with the working mediums flowing through the heat exchanger units in the other refrigerating machines.

Although certain preferred embodiments have been shown and described, it should be understood that many changes and modifications may be made therein without departing from the scope of the appended claims.

What is claimed as new and desired to be secured by Letters Patent of the United States is:

1. A method of absorbing thermal energy at a low temperature in a refrigerating machine having a compressor, a radiator having a passage formed therein for being cooled, a heat exchanger and an expander, which comprises:

maintaining a minimum pressure of a working medium in the refrigerating machine so as to be continuously equal to or below a critical pressure of said working medium;

compressing said working medium by said compressor;

discharging thermal energy of said working medium, after being compressed, into a refrigerant flowing through said passage formed in said radiator;

at least partly liquifying said working medium in said heat exchanger; and expanding the liquified working medium by said expander.

2. A method of absorbing thermal energy at a low temperature in a refrigerating machine having a compressor, a radiator having a passage formed therein for being cooled, a heat exchanger and an expander, which comprises:

maintaining a minimum pressure of a working medium in the refrigerating machine so as to be continuously equal to or below a critical pressure of said working medium;

compressing said working medium by said compressor;

discharging thermal energy of said working medium, after being compressed, into a refrigerant flowing through said passage formed in said radiator;

at least partly liquifying said working medium in said heat exchanger and said expander; and expanding said liquified working medium by said expander.

3. A method of absorbing thermal energy as set forth in claim 1, wherein said step of at least partly liquifying the working medium further comprises completely liquifying the working medium.

4. A method of absorbing thermal energy as set forth in claim 2, wherein said step of at least partly liquifying the working medium further comprises completely liquifying the working medium.

* * * * *